US006408943B1

(12) United States Patent
Schultz et al.

(10) Patent No.: US 6,408,943 B1
(45) Date of Patent: Jun. 25, 2002

(54) METHOD AND APPARATUS FOR PLACING AND INTERROGATING DOWNHOLE SENSORS

(75) Inventors: Roger Lynn Schultz, Denton; Clark Edward Robison, Plano; Russell Irving Bayh, III, Carrollton, all of TX (US); Benjamin Bernhardt Stewart, III, Aberdeen (GB); Brian George Nutley, Fareham (GB); Jamie George Oag; Nadir Mahjoub, both of Aberdeen (GB)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/617,212

(22) Filed: Jul. 17, 2000

(51) Int. Cl.[7] ..... E21B 33/13; E21B 47/00

(52) U.S. Cl. ..... 166/285; 166/250.01; 166/253.1; 166/250.14; 175/50

(58) Field of Search ..... 166/250.01, 253.1, 166/250.14, 285, 66, 276, 278, 280, 308; 175/40, 41, 50, 58, 77, 78; 73/152.24, 152.01

(56) References Cited

U.S. PATENT DOCUMENTS 3,489,219 A * 1/1970 Higgins
4,120,166 A * 10/1978 Brooks
4,775,009 A * 10/1988 Wittrisch et al.
4,787,465 A 11/1988 Dickinson, III et al.
4,850,440 A 7/1989 Smet
4,872,509 A 10/1989 Dickinson et al.
5,189,415 A 2/1993 Shimada et al.
5,209,309 A 5/1993 Wilson
5,524,709 A * 6/1996 Withers ..... 166/250.1
5,720,354 A 2/1998 Stump et al.
6,070,662 A 6/2000 Ciglenec et al.

OTHER PUBLICATIONS

A.W. Iyoho, Et Al., Petroleum Applications of Emerging High–Pressure Waterjet Technology, SPE 26347, 1993, Society of Petroleum Engineers, U.S.A.

A.D. Peters, Et Al., New Well Completion and Stimulation Techniques Using Liquid Jet Cutting Technology, 1993, SPE 26583, Society of Petroleum Engineers, U.S.A.

Wade Dickinson, Et Al., Coiled–Tubing Radials Placed By Water–Jet Drilling: Field Results, Theory and Practice, 1993, SPE 26348, Society of Petroleum Engineers, U.S.A.

* cited by examiner

*Primary Examiner*—David Bagnell
*Assistant Examiner*—Jennifer Dougherty
(74) *Attorney, Agent, or Firm*—William M. Imwalle; David W. Carstens

(57) ABSTRACT

A method and system is shown to passively monitor cement integrity within a wellbore. Different types of sensors (pressure, temperature, resistivity, rock property, formation property etc.) are "pumped" into place by placing them into a suspension in the cement slurry at the time a well casing is being cemented. The sensors are either battery operated, or of a type where external excitation, (EMF, acoustic, RF etc.) may be applied to power and operate the sensor, which will send a signal conveying the desired information. The sensor is then energized and interrogated using a separate piece of wellbore deployed equipment whenever it is desired to monitor cement conditions. This wellbore deployed equipment could be, for example, a wireline tool.

20 Claims, 4 Drawing Sheets

METHOD AND APPARATUS FOR PLACING AND INTERROGATING DOWNHOLE SENSORS

BACKGROUND OF THE INVENTION

1. Technical Field

The present invention relates to a method and apparatus for placing sensors downhole in a well to monitor relevant formation characteristics. Specifically, the sensors can be flowed into the formation in the cement, or other suitable material, used to case the well. Alternatively, the sensors can be physically bored into the formation with a device described herein.

2. Description of the Related Art

Understanding an oil-bearing formation requires accurate knowledge of many conditions, such as critical rock and formation parameters at various points in the zones or formations that the oil bearing formation encompasses. Fluid pressure in the formation, its temperature, the rock stress, formation orientation and flow rates are a few examples of measurements taken within the formation which are useful in reservoir analysis. Having these formation/rock measurements available external to the immediate wellbore in wells within a producing field would facilitate the determination of such formation parameters such as vertical and horizontal permeability, flow regimes outside the wellbores within the formations, relative permeability, water breakthrough condensate banking, and gas breakthrough. Determinations could also be made concerning formation depletion, injection program effectiveness, and the results of fracturing operations, including rock stresses and changes in formation orientation, during well operations.

In addition to understanding oil bearing formations, the condition of the material used to set casing in a well is of critical interest in monitoring the integrity of a well completion. While cement is commonly used to set casing, other materials such as resins and polymers could be used. So while the term cement is used in this description, it is meant to encompass other suitable materials that might be used now or in the future to set casing. Pressure, temperature and stress, are a few examples of measurements taken within the cement that might be useful in determining the condition of the cement in a well. Various types of transducers placed near the cement/wellbore interface could be used to monitor the condition of the rock or formations outside the wellbore. Having these formation/rock measurements available external to the immediate wellbore in wells within a producing field would facilitate the determination of such formation parameters such as vertical and horizontal permeability, flow regimes outside the wellbores within the formations, relative permeability, potential fines migration, water breakthrough, and gas breakthrough. Determinations could also be made concerning formation depletion, fines migration, injection program effectiveness, and the results of fracturing operations, including rock stresses and changes in formation orientation, during well operations.

Historically, reservoir analysis has been limited to the use of formation measurements taken within the wellbores. Measurements taken within the wellbore are heavily influenced by wellbore effects, and cannot be used to determine some reservoir parameters. Well conditions such as the integrity of the cement job over time, pressure behind the casing, or fluid movement behind the casing cannot be monitored using the wellbore measurements.

Therefore, it is desirable to have a method and system that may be used to passively monitor reservoir/formation parameters at all depths and orientations outside a wellbore as well as having a method and system to passively monitor cement integrity. It is further desirable to have a method and system to take these measurements without compromising the casing, cement or any other treatment outside or inside the casing.

SUMMARY

The present invention provides a method and system that may be used to passively monitor cement integrity and reservoir/formation parameters near the wellbore at all depths and orientations outside a wellbore. These measurements may be taken without compromising the casing, cement or any other treatment outside or inside the casing. In addition, sensors may be deployed in many more locations because of the non-intrusive nature of reading the sensors once they are in place.

In one embodiment, different types (pressure, temperature, resistivity, rock property, formation property etc.) of sensors are "pumped" into place by placing them into a suspension in the cement slurry at the time a well casing is being cemented. The sensors are either battery operated, or of a type where external excitation, (EMF, acoustic, RF etc.) may be applied to power and operate the sensor, which will send a signal conveying the desired information. The sensor may then be energized and interrogated using a separate piece of wellbore deployed equipment whenever it is desired to monitor cement or formation conditions. This wellbore deployed equipment could be, for example, a wireline tool. Having sensors placed in this way allows many different types of measurements to be taken from the downhole environment. Looking at readings taken at different locations will allow directional properties such as permeability to be examined. Sensors placed close to the wellbore can be used to monitor the well integrity by disclosing information about cement condition, casing wear/condition etc. Sensors placed closer to the cement/wellbore interface provide reservoir or rock property measurements, which may be used in reservoir analysis.

In another embodiment, the sensors are placed into the formation at or outside the wellbore and may be interrogated whenever it is desired to monitor well or formation conditions. One method of placing the sensors into the formation is to use technology similar to side bore coring tools which remove samples in a direction that is perpendicular to the wellbore. Another method involves placing the sensors into the gravel slurry used for gravel packing and frackpacking operations thus allowing the sensors to migrate into the formation with the fracpack.

There are many advantages of the proposed system. First, non-intrusive downhole measurements may be taken from numerous locations in the downhole environment. Next, the integrity of the cement job can be closely monitored for initial quality, and degradation with time. Further, many transducers may be placed into the well with relatively low deployment cost. Also, very accurate measurements can be taken because of transducer placement outside the wellbore. Also, very long service life of transducers is achieved because power is supplied by a wellbore device capable of supplying transducer excitation power. Finally, fluid movement and pressure behind the casing may be measured by comparing the many available downhole measurements.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION

Figure 1:
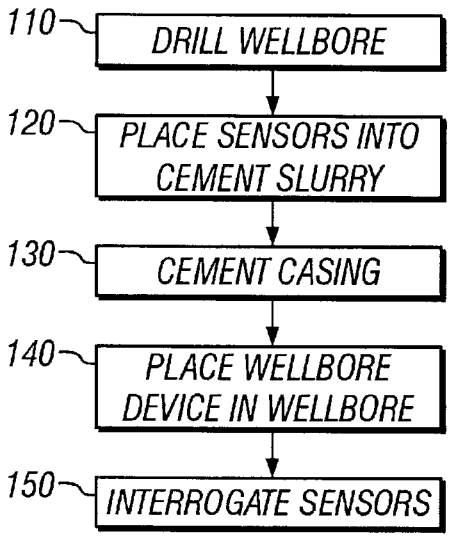
FIG. 1 shows a flow chart for placing sensors within the cemented casing of a wellbore.
Figure 2:
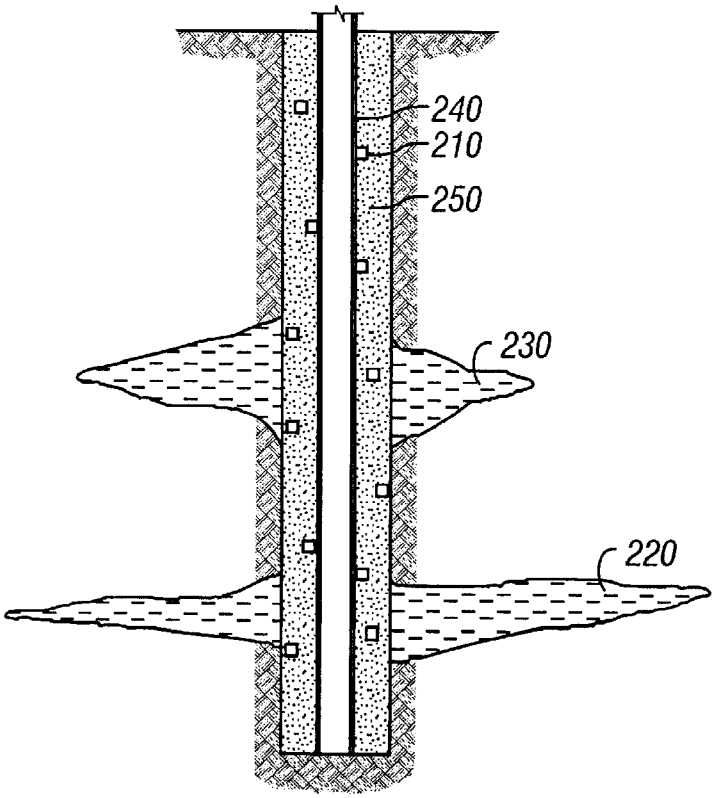
FIG. 2 depicts a wellbore with sensors located within the cemented casing.

A presently preferred embodiment of the present invention for placing sensors into a wellbore casing will now be described with reference to FIGS. 1 and 2. FIG. 1 shows a flowchart of a preferred embodiment of a method for placing sensors into a wellbore casing. FIG. 2 illustrates a cross-sectional view of a wellbore and casing with sensors placed therein.

A wellbore 240 is drilled into the earth using conventional methods and tools well known to those skilled in the art (step 110). Sensors 210 are placed into a cement slurry (step 120). A casing is placed into wellbore 240 and the cement slurry containing sensors 210 is pumped into wellbore 240 to provide a cemented casing 240 (step 130). A wellbore device (not shown in FIG. 2) is then placed into wellbore 240 (step 140). Sensors 210 are then interrogated with the well bore device (step 150). The wellbore device could be for example a wireline tool or a drill pipe conveyed system. Sensors 210 will typically be transducers which are either battery operated, or of a type where external excitation (EMF, acoustic, RF, etc.) may be applied to power and operate the transducer, which will send a signal conveying the desired information. Sensors 210 may be interrogated whenever desired to monitor cement or formation conditions. Sensors 210 may be of many different types such that many different types of conditions may be monitored. Such monitored conditions include pressure, temperature, resistivity, rock properties, and formation properties. Other monitored conditions include, but are not limited to, paramagnetic properties, magnetic fields, magnetic flux leak, pulse eddy current, and polar spin. Looking at different readings taken at different locations will allow directional properties such as permeability to be examined. Sensors 210 placed close to the wellbore can be used to monitor the well integrity by disclosing information about cement condition, casing wear/condition etc. Sensors 210 placed closer to the cement/wellbore interface provide reservoir or rock property measurements which may be used in reservoir analysis.

There are many advantages to placing sensors within the cemented well casing. Nonintrusive downhole measurements may be taken from numerous locations in the downhole environment. The integrity, such as micro-annulus, of the cement job can be closely monitored for initial quality and degradation with time. Many sensors may be placed into the well with relatively low deployment cost. Very accurate measurements can be taken because of sensor placement outside of the wellbore. Very long service life of the sensors because the power is supplied by a wellbore device capable of supplying transducer excitation power. Fluid movement and pressure behind the casing may be measured by comparing the many available downhole measurements.

Figure 3:
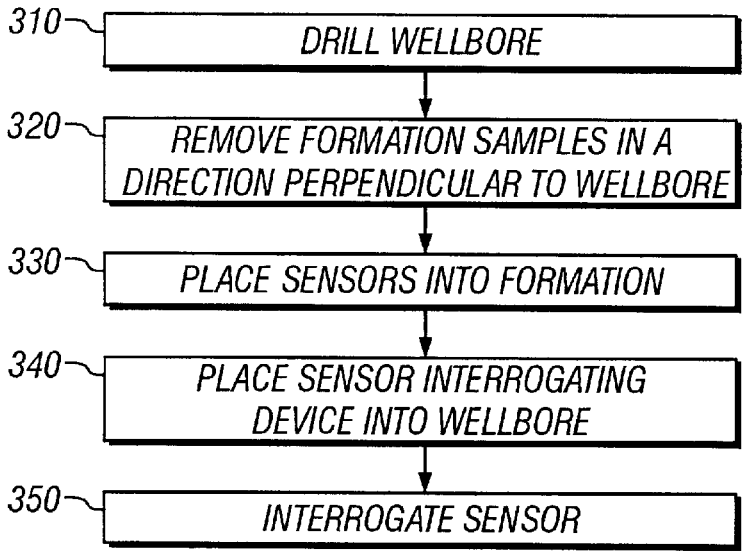
FIG. 3 shows a flow chart for placing sensors into the formation.
Figure 4:
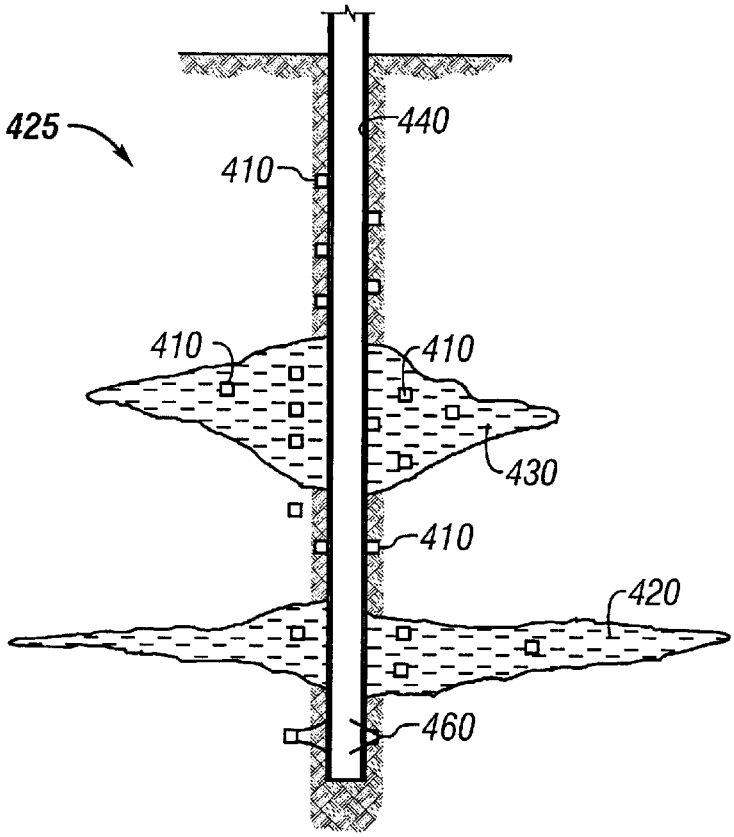
FIG. 4 depicts a wellbore and formation with sensors located in the formation.

Turning now to FIGS. 3 and 4, a method of placing sensors into a formation will be described. FIG. 3 depicts a flow chart for a presently preferred method of placing sensors into a formation. FIG. 4 shows a cross-sectional view of a well bore and formation with sensors located within the formation.

A wellbore 440 is drilled using conventional techniques and devices well known to one skilled in the art (step 310). Formation samples are removed from the formations 420, 425, and 430 using for example, a side bore coring tool, in a direction perpendicular to wellbore 440 (step 320). The maximum distance bored out with standard coring tools is typically around 4 feet from the wellbore 440. One example of a side bore coring tool may be found in U.S. Pat. No. 5,209,309 issued to Wilson which is hereby incorporated by reference. Sensors 410 are then placed into the formations 420, 425, and 430 (step 330). A sensor interrogating device is then placed into the wellbore (step 340). Sensors 410 are then interrogated whenever it is desired to gather some information that sensors 410 can gather (step 350).

In one variation of this method, rather than removing formation samples with a side bore coring tool, the formations 420, 425, and 430 are fractured and packed with gravel ("fracpacking"). Sensors 410 are placed in the gravel slurry prior to packing the fracture. Thus, sensors 410 are placed outside the wellbore and into the formation. Alternatively, perforations 460 can be made in the wellbore 440 casing and the sensors 410 allowed to migrate outside the wellbore 440 with the gravel slurry. The gravel slurry and fracpacking will be described in more detail below.

As with sensors 210, sensors 410 will typically be transducers which are either battery operated, or of a type where external excitation (EMF, acoustic, RF, etc.) may be applied to power and operate the transducer, which will send a signal conveying the desired information. Alternatively, the sensors 410 may be powered using fuel cell or power cell. The fuel cell or power cell may be part of the sensors 410 or built as an addition. Formation movement, noise or fluid flow (i.e. effluent flow) could be used to charge or recharge the cell power source. Sensors 410 may be interrogated whenever desired to monitor cement or formation conditions. Sensors 410 may be of many different types such that many different types of conditions may be monitored. Such monitored conditions include pressure, temperature, resistivity, rock properties, and formation properties. Other monitored conditions include, but are not limited to, paramagnetic properties, magnetic fields, magnetic flux leak, pulse eddy current, and polar spin. Sensors 410 placed close to the wellbore 440 can be used to monitor the well integrity by disclosing information about cement condition, casing wear/condition etc. Sensors 410 placed further into a formation or other surrounding substrate will provide very accurate reservoir or rock property measurements.

It should be noted that sensors 210 and 410 may be calibrated before placement and may be recalibrated after placement in the formation or well casing. For example, a radio or acoustic signal may be sent to each or sensors 210 or 410, after placement, initiating a calibration response in each of sensors 210 or 410.

There are many advantages to placing sensors outside the wellbore. Non-intrusive downhole measurements may be taken from numerous locations in the downhole environment. Very accurate measurements can be taken because of optimal transducer placement outside the wellbore Very long service life of transducers because power is supplied by a wellbore device capable of supplying transducer excitation. Direction formation properties may be measured by comparing the many available downhole measurements.

The particulate material utilized in accordance with the present invention to carry sensors 410 into formations 420, 425, and 430 is preferably graded sand which is sized based on a knowledge of the size of the formation fines and sand in an unconsolidated subterranean zone to prevent the formation fines and sand from passing through the gravel pack. The graded sand generally has a particle size in the range of from about 10 to about 70 mesh, U.S. Sieve Series. Preferred sand particle size distribution ranges are one or more of 10–20 mesh, 20–40 mesh, 40–60 mesh or 50–70 mesh, depending on the particle size and distribution of the formation fines and sand to be screened out by the graded sand.

The particulate material carrier liquid utilized, which can also be used to fracture the unconsolidated subterranean zone if desired, can be any of the various viscous carrier liquids or fracturing fluids utilized heretofore including gelled water, oil base liquids, foams or emulsions. The foams utilized have generally been comprised of water based liquids containing one or more foaming agents famed with a gas such as nitrogen. The emulsions have been formed with two or more immiscible liquids. A particularly useful emulsion is comprised of a water-based liquid and a liquified normally gaseous fluid such as carbon dioxide. Upon pressure release, the liquified gaseous fluid vaporizes and rapidly flows out of the formation.

The most common carrier liquid/fracturing fluid utilized heretofore which is also preferred for use in accordance with this invention is comprised of an aqueous liquid such as fresh water or salt water combined with a gelling agent for increasing the viscosity of the liquid. The increased viscosity reduces fluid loss and allows the carrier liquid to transport significant concentrations of particulate material into the subterranean zone to be completed.

A variety of gelling agents have been utilized including hydratable polymers which contain one or more functional groups such as hydroxyl, cis-hydoxyl, carboxyl, sulfate, sulfonate, amino or amide. Particularly useful polymers are polysaccharides and derivatives thereof which contain one or more of the monosaccharides units galactose, mannose, glucoside, glucose, xylose, arabinose, fructose, glucuronic acid or pyranosyl sulfate. Various natural hydratable polymers contain the foregoing functional groups and units including guar gum and derivatives thereof, cellulose and derivatives thereof, and the like. Hydratable synthetic polymers and co-polymers which contain the above mentioned functional groups can also be utilized including polyacrylate, polymeythlacrylate, polycrylamide, and the like.

Particularly preferred hydratable polymers, which yield high viscosities upon hydration at relatively low concentrations, are guar gum and guar derivatives such as hydroxypropylguar and carboxymethylguar and cellulose derivatives such as hydroxyethylcellulose, carboxymethylcellulose and the like.

The viscosities of aqueous polymer solutions of the types described above can be increased by combining crosslinking agents with the polymer solutions. Examples of crosslinking agents which can be utilized are multivalent metal salts or compounds which are capable of releasing such metal ions in an aqueous solution.

The above described gelled or gelled and cross-linked carrier liquids/fracturing fluids can also include gel breakers such as those of the enzyme type, the oxidizing type or the acid buffer type which are well known to those skilled in the art. The gel breakers cause the viscous carrier liquids/fracturing fluids to revert to thin fluids that can be produced back to the surface after they have been utilized.

The creation of one or more fractures in the unconsolidated subterranean zone to be completed in order to stimulate the production of hydrocarbons therefrom is well known to those skilled in the art. The hydraulic fracturing process generally involves pumping a viscous liquid containing suspended particulate material into the formation or zone at a rate and pressure whereby fractures are created therein. The continued pumping of the fracturing fluid extends the fractures in the zone and carries the particulate material into the fractures. Upon the reduction of the flow of the fracturing fluid and the reduction of pressure exerted on the zone, the particulate material is deposited in the fractures and the fractures are prevented from closing by the presence of the particulate material therein.

As mentioned, the subterranean zone to be completed can be fractured prior to or during the injection of the particulate material into the zone, i.e., the pumping of the carrier liquid containing the particulate material through the slotted liner into the zone. Upon the creation of one or more fractures, the particulate material can be pumped into the fractures as well as into the perforations and into the annuli between the sand screen and shroud and between the shroud and the well bore.

Figure 6A:
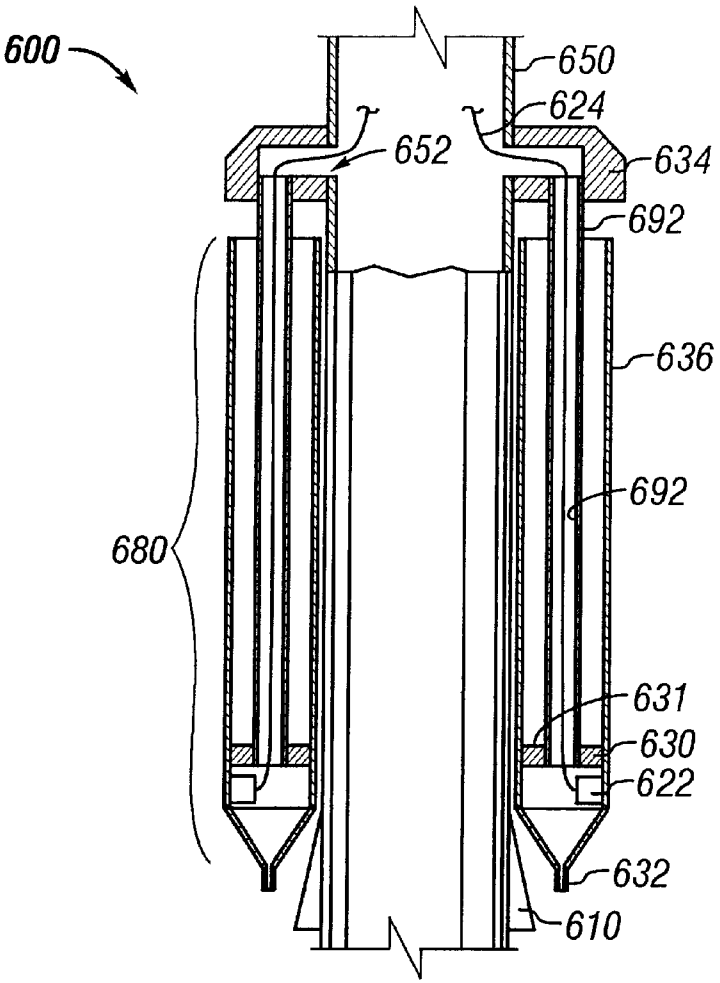
FIGS. 6A–6C depict a tool for drilling away from a wellbore and placing a sensor into a formation.
Figure 5:
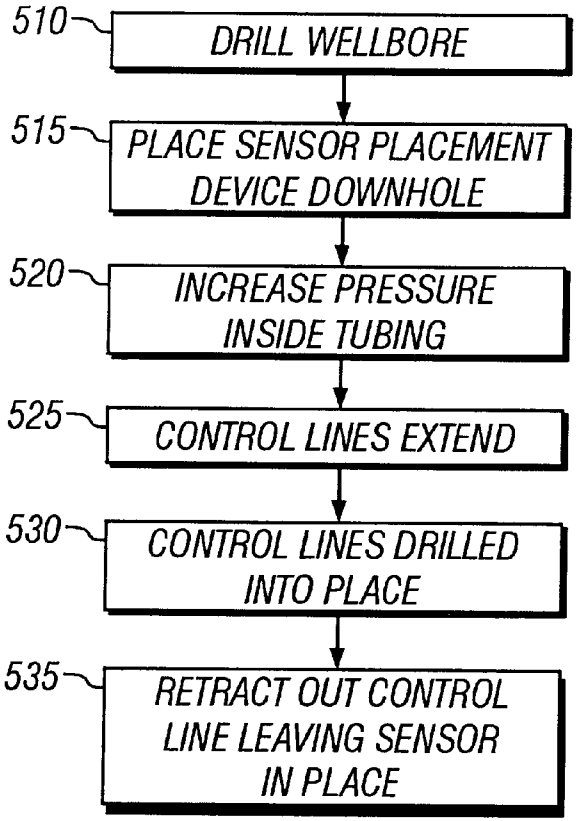
FIG. 5 shows a flow chart for placing a sensor into a formation by drilling laterally away from a wellbore.
Figure 6B:
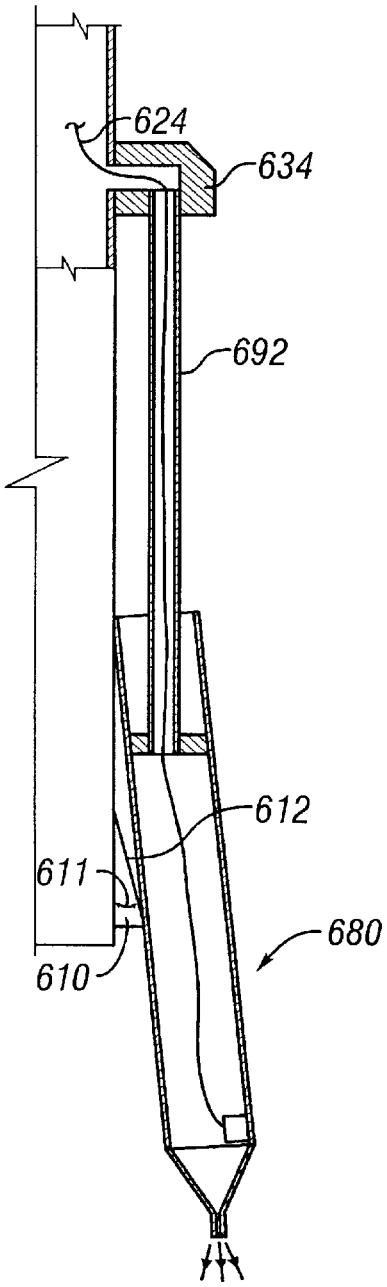
Figure 6C:
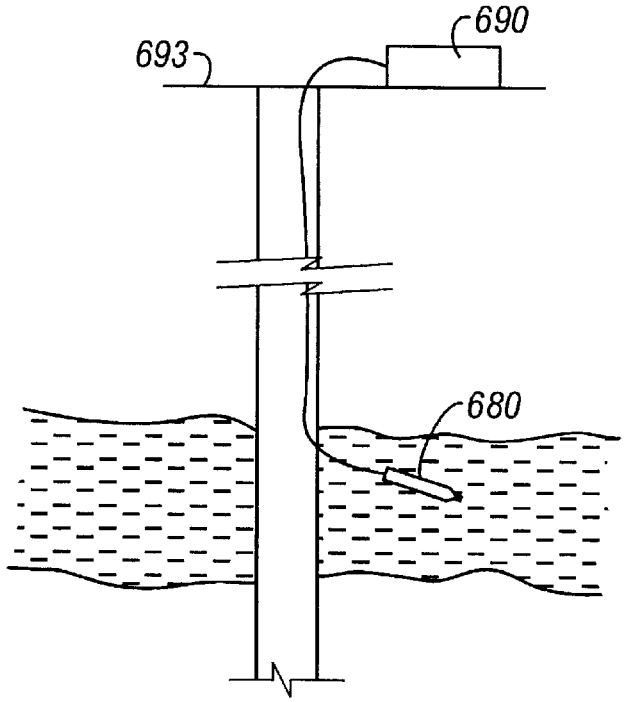

In another presently preferred embodiment, sensors are placed into a formation by drilling laterally away from a borehole. FIG. 5 shows a flow chart of this method. FIGS. 6A–6C depict an instrument suitable for performing this method. As used herein, drilling laterally away from a borehole means in a direction greater than zero degrees away from the general longitudinal (as opposed to radial) direction of the borehole at that particular location and, thus, can include drilling up or down away from the borehole when the longitudinal direction of the borehole is horizontal with respect to the earth's surface. Furthermore, there is no requirement that drilling laterally away from a borehole mean normal or perpendicular to the surface of the wellbore.

A borehole 602 is drilled using conventional methods well known to one skilled in the art (step 510). A sensor placement device 600 is then placed into the borehole 602 (step 515). Sensor placement device 600 consists of tubing 650, a fluid diverter 634, a control line 692, outer tubing 636, pistons 630 and 631, a sensor 622, a nozzle 632, a deflector 610, and a wire 624. Tubing 650 is lowered into the borehole 602 from the earth's surface 693. Tubing 650 may be coiled tubing of a type well known to one skilled in the art.

Attached to tubing 650 are fluid diverters 634. An opening 652 allows fluid to flow from tubing 650 through fluid diverters 634 and into control line 692 which is attached to fluid diverters 634 by Swagelok fittings. At the end of control tube 692 are two pistons 630 and 631. Pistons 630 and 631 provide an offset area for pressure to work against so the outer tube 636 (also called a cylinder) will stroke downward upon application of pressure. This is the placement means for sensor 622. Pistons 630 and 631 are rigidly attached to fluid or flow diverters 634. In one embodiment, pistons 630 and 631 may be a smaller size of control line than outer tubing 636. Although described herein with reference to two pistons, multiple pistons may be used as well and may be deployed in a variety of directions, such as, for example, up, down, or at an angle, without departing from the scope and spirit of the present invention.

Overlying control line 692 is outer tubing 636. Outer tubing 636 is pushed onto pistons 630 and 631 and remains in a retracted position until pressure is applied. Upon application of pressure, nozzle 632 provides a jetting action for the fluid, which effectively cuts through the formation. As nozzle 632 erodes the formation material, the outer tubing 636 is allowed to move downwards. Sensor 622 is attached to the inside of outer tubing 636 by a threaded carrier sub that has an open ID to allow fluid to bypass to nozzle 632. Outer tube 636 has a nozzle 632 at one end. Sensor 622 is attached to outer tubing 636, either by integration into the housing wall or surface mounting, and is connected to wire 624 that connects sensor 622 to a surface electronics 690. Surface electronics 690 may include a recorder to record the data received from sensor 622 for later processing possibly at a remote site and may also include processing equipment to process the data received from sensor 622 as it is received. Furthermore, surface electronics 690 may be attached to display devices such as a cathode ray tube (CRT) or similar computer monitor device and/or to a printer.

After sensor placement device 600 has been placed down hole (step 515), the fluid pressure inside tubing 650 is increased (step 520). The pressure may be increase by, for example, a pump on the surface is connected to the coiled tubing 650, which provides the high pressure source required to operate the drilling operation or by a subsurface powered pump. The increased fluid pressure causes fluid to flow through opening 652 into fluid diverter 634 which diverts fluid into control line 692 causing sensor pods 680 to extend (step 525). Water may be used as the working fluid unless this will adversely affect the formation sandface. In such event, a conventional mud may be used. The fluid may also be a treated liquid comparable with the reservoir to minimize formation damage and may possibly be enhanced with friction reducing polymers and abrasives to enhance jet drilling efficiency. The fluid flows from control line 692 into outer tubing 636. The fluid exits outer tubing 636 through nozzle 632. The fluid exiting through nozzle 632 cuts through the surrounding rock, thus drilling the sensor pod 680 into place as housing 636 continues to extend exerting pressure on sensor pod 680 (step 530). Deflector 610 causes sensor pod 680 to be deflected outward into the formation 604.

The surface 612 of deflector 610 can have an angular 611 displacement away from the surface of tubing 650 of just greater than zero degrees to almost 90 degrees depending on the direction an operator wishes to place sensor pod 680. The greater the angular 611 displacement, the more sensor pod 680 will be deflected away from tubing 650 such that an angular 611 displacement of almost 90 degrees will result in the sensor pod being deflected in a direction almost perpendicular to the surface of tubing 650. Deflector 610 may be constructed from any suitably hard material that will resist erosion. For example, alloy stainless steel is an appropriate and suitable material from which to construct deflector 610. Typically, deflector 610 is welded to the base pipe and deflector 610 has a port drilled through it to allow fluid passage.

Once sensor pod 680 has been drilled into the formation 604, control line 692 may be retracted out leaving sensor pod 680 in the formation (step 535). By leaving control line 692 in place rather than removing it after sensor placement, wire 624 may be better protected. Sensor 622 remains connected to surface electronics 690 via wire 624. Wire 624 can be an electric wire capable of carrying electronic signals or it can be a fiber optic cable.

It should be noted that sensor 622 may be recalibrated after placement of sensor 622 downhole in the formation. Such calibration may be accomplished, for example, by means of transmissions via wire 624 or may be through radio and/or acoustic signals.

To aid in understanding the present invention, refer to the following analogy. Consider a garden hose with a nozzle attached to the end. With the end of the nozzle pushed into the ground, increase the water pressure in the garden hose. The water exiting the nozzle provides an effective drilling tool that allows the hose to be pushed into the ground. This is the principle behind the present invention. The outer tubing will stroke downwards as the formation material is removed. The wire attached to the sensor must have enough length to accommodate the stoke length of the cylinder. The wire may feed through the deflector and continue up the outside of the coiled tubing. This may be useful if the coiled tubing is removed after sensor placement. Otherwise as discussed above, the wire will remain inside the coiled tubing where it is better protected.

Although the present invention has been described primarily with reference to interrogating the sensors with a wireline tool, other methods of interrogating the sensor may be utilized as well without departing from the scope and spirit of the present invention. For example, the sensors could be interrogated by something built into the completion or by a reflected signal that could power up and interrogate the sensor or sensors.

The description of the present invention has been presented for purposes of illustration and description, but is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

We claim:

1. A method of placing sensors in a borehole, the steps comprising:

drilling a borehole with a drill apparatus;

forming a well casing therein; and placing at least one remote sensor into cement slurry as the well casing is being cemented;

wherein said remote sensor has no external connections.

2. The method as recited in claim 1, wherein the at least one remote sensor comprises a transducer.

3. The method as recited in claim 1, wherein the at least one remote sensor comprises a pressure measurement device.

4. The method as recited in claim 1, wherein the at least one remote sensor comprises temperature measurement device.

5. The method as recited in claim 1, wherein the at least one remote sensor comprises a resistivity measurement device.

6. The method as recited in claim 1, wherein the at least one remote sensor measures rock properties.

7. The method as recited in claim 1, wherein the at least one remote sensor measures formation properties.

8. The method as recited in claim 1, wherein the at least one remote sensor measures paramagnetic properties.

9. The method as recited in claim 1, wherein the at least one remote sensor measures magnetic fields.

10. The method as recited in claim 1, wherein the at least one remote sensor measures pulse eddy current.

11. The method as recited in claim 1, wherein the at least one remote sensor measures polar spin.

12. The method as recited in claim 1, wherein the at least one remote sensor measures magnetic flux leak.

13. The method as recited in claim 1, wherein the at least one remote sensor measures well integrity.

14. The method as recited in claim 1, wherein the at least one remote sensor measures casing wear.

15. The method of claim 1, wherein said sensor contains a member of the group consisting of a transducer, a pressure measurement device, a temperature measurement device, and a resistivity measurement device.

16. A method of placing sensors in a borehole, the steps comprising:

drilling a borehole with a drill apparatus;

forming a well casing therein;

suspending sensors in a cement slurry to form a slurry suspension; and cementing said well casing using said slurry suspension.

17. The method of claim 16, wherein said sensor measures a member of the group consisting of rock properties, formation properties, paramagnetic properties, magnetic fields, pulse eddy current, polar spin, magnetic flux leak, well integrity, and casing wear.

18. The method of claim 16, wherein said sensor is powered by battery.

19. The method of claim 17, wherein said sensor is powered by external excitation.

20. A method of placing sensors in a borehole, the steps comprising:

drilling a borehole with a drill apparatus;

forming a well casing therein; and placing at least one remote sensor into cement slurry as the well casing is being cemented;

wherein said remote sensor remains in said borehole permanently.

* * * * *